US005725280A

United States Patent [19]

Kushnir

[11] Patent Number: 5,725,280

[45] Date of Patent: Mar. 10, 1998

[54] SURGEON'S PERCH

[76] Inventor: Michael Kushnir, 7807 N. Lake Dr., Fox Point, Wis. 53217

[21] Appl. No.: 689,196

[22] Filed: Aug. 5, 1996

[51] Int. Cl.[6] ..... A47C 16/00

[52] U.S. Cl. ..... 297/423.44; 248/456

[58] Field of Search ..... 248/454, 456; 297/4, 344.12, 344.14, 423.19, 423.25, 423.38, 423.44, 338, 337

[56] References Cited

U.S. PATENT DOCUMENTS

| | | | |
|---|---|---|---|
| 1,699,309 | 1/1929 | Powers | 297/344.14 |
| 2,132,331 | 10/1938 | Wanamaker | 297/338 X |
| 3,754,787 | 8/1973 | Garber | 297/423.38 X |
| 4,109,961 | 8/1978 | Opsvik | 297/338 |
| 5,015,037 | 5/1991 | Giblin et al. | 297/452.1 |
| 5,167,436 | 12/1992 | Wu | 297/338 |
| 5,303,981 | 4/1994 | Wilder et al. | 297/338 |

*Primary Examiner*—Milton Nelson, Jr.

[57] ABSTRACT

The surgeon's perch comprises a base, a perch member upon which a surgeon may rest his torso, the perch member being at a pre-selected elevated level above the base, and an elevated foot rest positioned above the base and below the perch member.

14 Claims, 1 Drawing Sheet

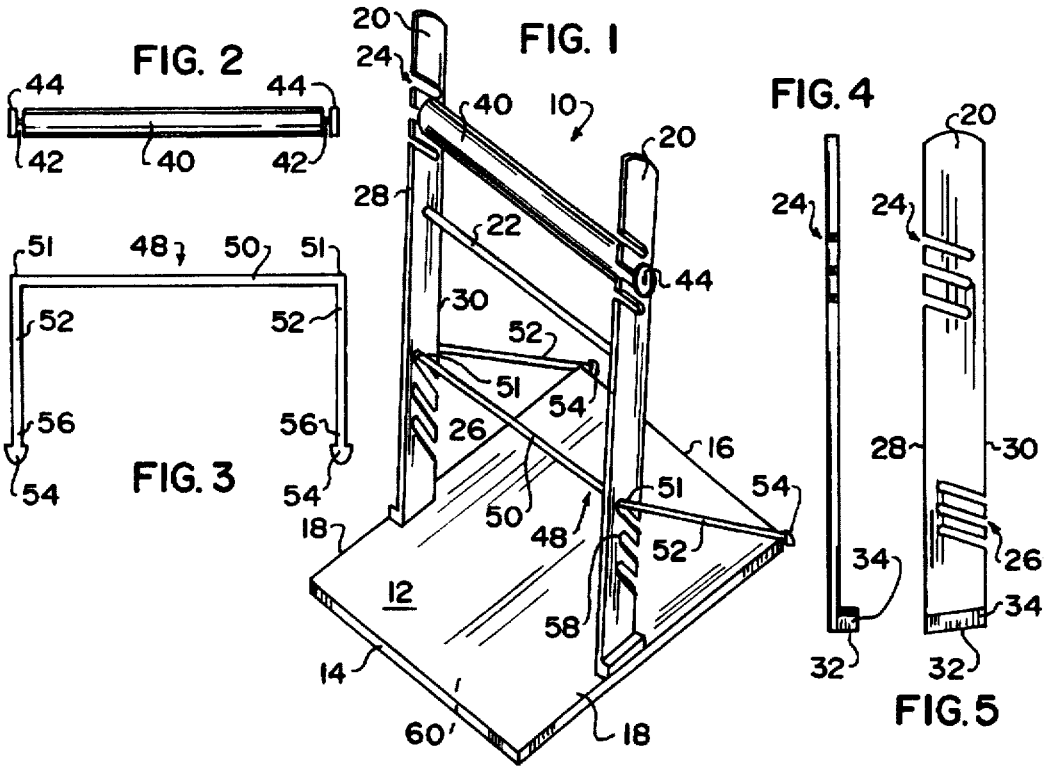
FIG. 1
FIG. 2
FIG. 3
FIG. 4
FIG. 5
10
12
14
16
18
20
22
24
26
28
30
32
34
40
42
44
48
50
51
52
54
56
58
60'
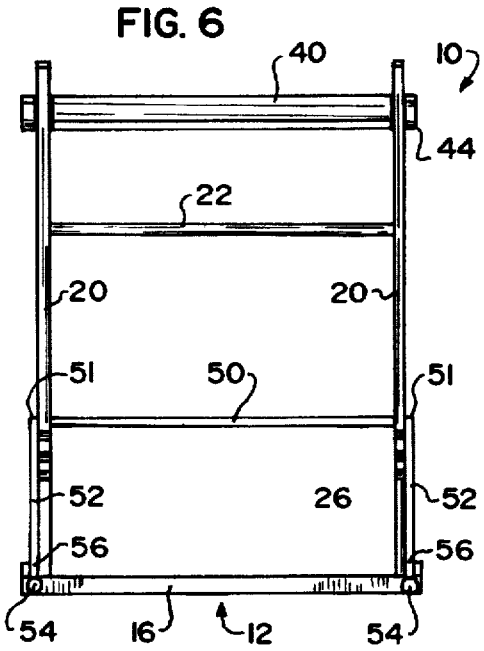
FIG. 6
10
12
16
20
22
26
40
44
50
51
52
54
56
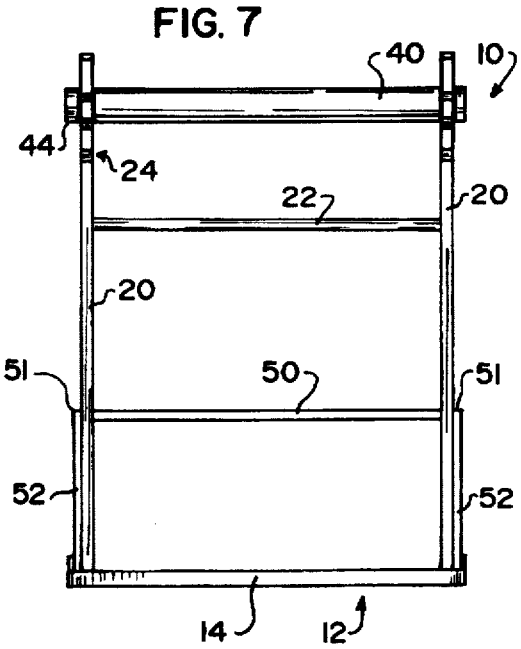
FIG. 7
10
12
14
20
22
24
40
44
50
51
52

SURGEON'S PERCH

BACKGROUND OF THE INVENTION

1. Field of the Invention

The present invention relates to a perch for use by a surgeon. More particularly, the surgeon's perch comprises a base, a perch member upon which a surgeon may rest by placing his buttocks thereupon, the perch being elevated to one of a plurality of provided elevations above the base, and further including a foot rest member which first serves as a rod or the like upon which the surgeon may rest his feet and secondly, by its inherent configuration, provides a brace for the elevated perch member, the brace acting against the effect of the surgeon's weight being placed upon the perch member.

2. Prior Art

Present day surgical procedures, such as open heart surgery, frequently last for great lengths of time, often requiring a surgeon to operate for as long as six (6) or more hours during a single procedure. Such modern technology imposes at times nearly intolerable physical loads on the surgeons, particularly upon professionals who may be of an age or physical condition which causes such extreme conditions of physical exertion. Oftentimes such surgical procedures require a period of interruption during which the surgeon leaves the operating arena to rest. Such rest period produces an underlying disadvantage to the patient inasmuch as the patient is maintained under the effect of an anesthetic during the time that the surgeon requires to rest prior to continuing and/or completing the operative procedure.

Surgeons are also placed under necessary physical parameters which also increase physical exertion. One such parameter deals with the fact that the surgeon, due to the construction of typical operating tables, in combination with a typically limited space available within an operating arena, is required to be in an upright position. Further, the surgeon must be elevated to a position above the level at which the patient is positioned so that the surgeon is capable of reaching an opposite side of the table. This is accomplished typically by having the surgeon stand next to the table with the table being positioned at a vertical height where, when the surgeon's arms are in a depending position, his hands must necessarily be above the level of the upper surface of the operating table upon which the patient is placed. As a result of such necessary parameters, presently available apparatus for supporting an operating surgeon are less than optimum for minimizing physical exertion by long procedures. Further, long periods of sitting without being easily able to change positions, causes circulatory depletion in the lower limbs as well as causing back and neck strain.

For example, a rotatable chair for a doctor has been disclosed in German Patent No. 1,900,949 wherein a ring-shaped foot operated switching plate is arranged above a base or foot frame formed of individual cantilever or overhang members. The switching plate, through the agency of a switching plunger and a tiltable lever of a valve, activates a gas spring or cushion and thus renders possible infinite elevation adjustments of the seat. In order to ensure for such elevational adjustment of the seat, depending upon the degree of loading or unloading thereof, during treatment by the physician, it is necessary with this rotatable chair that the doctor lift his body weight with one foot and with his other foot operate the switch pad. It will be evident that such requires undesired shifting of the weight of the body as well as one-sided loading of the body, which does not guarantee either the necessary secure and steady standing of the rotatable chair upon the floor or the required firm standing of the doctor, and thus, restricts to an unwarranted extent the activity of the treating physician.

Also, a combined surgical chair having a pivotable work chair for the treating physician is taught in German Patent No. 1,110,818 wherein-there is provided a pivotable arm having a holding device for a foot pedal switch for regulating, for instance, a drilling machine used by a dentist at the neighborhood of the surgical chair. The pivotable arm, for instance of resilient construction, adjustable to a certain braking action, and arranged with the foot rest flat above the floor is designed such that when it is loaded by the weight of the foot of the doctor the load is taken up by the floor, and hence, when necessary, the work chair or seat can be rocked without difficulty out of the working region and the foot pedal switch remains as previously in its predetermined position.

Further, U.S. Pat. No. 4,061,304 teaches a surgical chair for a doctor embodying an infinitely elevationally adjustable seat connected with a support column, a stand tube arranged within the support column, at which there is attached a base frame equipped with rollers and a lifting device within the stand tube. The lifting device is operatively connected with the support column and can be unlocked by a lever system so that the seat, depending upon the degree of loading thereof, is elevationally adjustable. A foot pedal located between two overhang members of the base frame is arranged with its upper edge at most four (4) centimeters above the floor and with adjustable freedom of movement with respect to the floor. The foot pedal is secured by a lever to an angle lever pivotably mounted at the stand tube and acts upon a plunger of the lifting device. At least three guide grooves are provided at the support column and extended uniformly about its inner periphery and parallel to its central axis. At least two superimposed sets of spaced rollers are secured at the outer periphery of the stand tube in operable association with the guide grooves arranged at the support column.

As will become apparent from a perusal of the state of the art, examples of which have been described above, it will be seen that such apparatus are complex, not simply modifiable to allow for quick adjustment, and, due to the complexity of the structures, are significantly expensive. Further, physical restrictions which are not conducive to the surgeon's positioning relative to the desired parameters is less than adequately accommodated by these structures.

SUMMARY OF THE INVENTION

Accordingly, it is a primary object of the invention to provide a perch upon which a surgeon may be comfortably seated with ease, the surgeon requiring a near vertical positioning with legs depending from the torso, in a manner such that the distance between the surgeon and the table are appropriately maintained with regard to reach as well as addressing the surgeon's position upon the support device accommodating the limited space in which the surgeon may work.

Further, it is an object of the invention to allow for simple adjustment of the seating perch and of a the foot rest to accommodate the individual physical needs of the surgeon.

Further, it is an object of the invention to provide a surgeon's perch which will meet the aseptic requirements which are standard in the operating arena.

Further, it is an object of the invention to provide an easily adjustable structure so that the surgeon may shift position as desired or required during a procedure.

Yet further, an object of the invention is to provide a surgeon's perch which may be modified as required to accommodate a particular configuration of an operating table base, while yet providing functionality with respect to the limited space available around the base of the operating table within which the surgeon and the perch must fit.

These objects as well as others are met by the surgeon's perch of the present invention, the surgeon's perch comprising a base which is created of a material which is trimmable to accommodate a plurality of embodiments of typical operating table bases, the surgeon's perch further including an elevated perch member upon which the surgeon's buttocks may rest, such perch member being easily adjustable for preferred fit to the surgeon's body requirements in the vertical plane, and a dual function foot rest elevated to a position between the perch member and the base, such foot rest being easily adjustable in the vertical plane to accommodate the surgeon's physical structure and/or desired lower limb position, without exceeding spatial parameters.

BRIEF DESCRIPTION OF THE PREFERRED EMBODIMENT

Other objects and advantages of the invention will become more apparent upon perusal of the detailed description thereof and upon inspection of the drawings in which:

FIG. 1 is a perspective view of the surgeon's perch made in accordance with the teachings of the present invention.

FIG. 2 is a top plan view of the perch member of the surgeon's perch upon which the buttocks of the surgeon rest.

FIG. 3 is a side view of the foot rest showing same to incorporate perpendicular legs at each end thereof.

FIG. 4 is a front end view of one of two mirror image side support bars of the perch of FIG. 1.

FIG. 5 is a perspective side view of the side support bar shown in FIG. 4.

FIG. 6 is a rear view of the surgeon's perch of FIG. 1.

FIG. 7 is a frontal view of the surgeon's perch of FIG. 1.

DESCRIPTION OF THE PREFERRED EMBODIMENT

Referring now to the drawings in greater detail, there is illustrated therein a surgeon's perch made in accordance with the teachings of the present invention and generally referred to by the reference numeral 10. As shown, the surgeon's perch 10 includes a planar base 12 having a forward end 14, a rear end 16 and two side edges 18. Rising from the base 12, along each side edge 18 thereof, at a position along the side edge 18 which is relatively centered, is a support bar 20, each side support bar 20 being a mirror image of the opposite support bar 20. Extending fixedly between the opposite support bars 20 is a horizontal brace member 22 which maintains the support bars 20 aligned relative to each other. Each support bar 20 includes a first, upper series or vertical plurality of slots 24 and a second, lower series or vertical plurality of slots 26. It will be seen that the upper slots 24 are downwardly angled from a forward end edge 28 of each support bar 20 and that the lower slots 26 are upwardly angled from a rear end edge 30 of each support bar 20.

Referring briefly to FIGS. 4 and 5, it will be seen that a lower end edge 32 of each support bar 20 includes a foot member or flange 34 which, as best illustrated in FIG. 1, aligns along the end edge 18 of the base 12, with the support bar 20 being laterally inwardly disposed relative to each foot member or flange 34. Further, as most particularly shown in FIG. 5, when the support bars 20 are placed at a substantially vertical position, the lower end edge 32 is seen to angle rearwardly upwardly. Such angulation to the lower end edge 32 of the support bars 20, as best shown in FIG. 1, provides the support bars 20 with the ability to engage the base 12 in a manner such that the bars 20 are slightly rearwardly tilted from vertical.

The requirement for such angulation is multifold. First, it will be understood that a perch member 40 is provided for the surgeon's perch 10, such perch member 40 being of a substantially cylindrical configuration and of a predefined length such that the member 40 extends substantially across an area between the mirror image support bars 20, support for the perch member 40 being provided by an end pin 42 provided at each end of the perch member 40, and each end pin 42 being slidably engageable in one of a preselected cooperating pair of slots 24, substantially as shown in FIG. 1.

The plurality of vertically aligned slots 24 has been provided to accommodate various body dimensions of the user as well as to accommodate a desired or required elevation of the torso of the user (not shown), above the level at which a patient (not shown) is positioned.

For ease in simple maneuverability of the perch member 40 between the plurality of predefined positions available, terminal hand grips 44 are provided, each of which extends laterally outwardly from one pin 42, such hand grips 44, when the perch member 40 is engaged as shown in FIG. 1, being positioned laterally outwardly of the support bars 20 such that, should a personal modification be required or desired, the user would engage the perch member 40 by simply grabbing the grips 44, sliding the perch member 40 upwardly and forwardly until pins 42 disengage from within the cooperating pair of slots 24, and sliding the perch member 40 into another of the plurality of slots 24, downwardly and rearwardly.

With respect to the second, lower series of slots 26, and with most particular reference to FIGS. 1 and 3, it will be seen that a foot rest 48 is also provided, the rest 48 including a center bar or pole 50 which, when engaged within a pair of cooperating slots 26 rests in a horizontal plane across the extent of the base 12 between the bars 20 and is of a length dimension such that, each end 51 thereof extends to a point slightly outwardly of a cooperating bar 20 as best shown in FIGS. 6 and 7. From this pole 50, a pair of end legs 52 extend perpendicularly, in co-planar fashion.

If desired, a non-skid material cap 54 may be provided on a free depending end 56 of each leg 52, as best shown in FIGS. 1 and 6. When the pole 50 is engaged within a selected pair of cooperating slots 26, such engagement is created by pushing the pole 50 forwardly and upwardly into each slot 26. Once the pole 50 is engaged within the slots 26 substantially as shown, and the legs 52 thereof are dropped, the non-skid material caps 54 thereof engage against a supporting surface (not shown) for the base 12. It will be understood that the legs 52 are of such a predefined length that, regardless of which pair of cooperating slots 26 is engaged, the capped ends 56 of the legs 52 will consistently contact the supporting surface for the base 12.

Once the surgeon's perch 10 is assembled as shown in FIGS. 6 and 7, the desirability of the particular configurations for the slots 24 and the slots 26, becomes more apparent.

In this respect, when the weight of a torso (not shown), bears against the perch member 40, via the buttocks (not shown) of a surgeon, the weight will cause the pins 42 to seek the most inner end position within the slots 24, with such position being easily maintained by the weight being borne.

Oppositely, with respect to the orientation of the slots 26 for the foot rest 48, when the capped ends 56 of the legs 52 are engaged against the supporting surface thereunder, the horizontal pole 50 is maintained at a most inwardly oriented position within the slots 26. The effect of the weight borne by the perch member 40 transfers down from the perch member 40 along the support bars 20, which, with their slightly rearwardly tilted orientation, produce a downwardly and rearwardly directed force upon a point of juncture between the pole 50 and the slots 26, aiding in maintenance of the position of the foot rest pole 50. It will also be understood that the legs 52 act in a bracing fashion against a closed end 58 of the engaged slots 26, as such bracing relates to the downwardly and rearwardly directed force generated by the weight being borne by the perch member 40.

Although not materially depictible, as stated hereinabove, it will be understood that the base 12 is created from a material which is trimmable to a selected configuration for the forward end 14 thereof, one such possible configuration being indicated by the dashed line 60 in FIG. 1. Such trimmability has been found desirable so that any of a plurality of operating table base configurations may be accommodated by the surgeon's perch 10. Also, it will be understood that the perch member 40 will preferably be made of a material which, for comfort as well as for secure seating, is made of a non-slippery and rather frictional type of material.

As described above, the surgeon's perch 10 of the present invention provides a number of advantages, some of which have been described above, and others of which are inherent in the invention. For example, ease in repositioning of the perch member 10 and the foot rest 48 allow for positional modification even during a surgical procedure, if a surgeon desired to vary his anatomical position for comfort and ease during the procedure. It will be understood that use of the surgeon's perch 10 will significantly decrease, if not altogether eliminate, the potential need for a surgeon to take a rest break during an exceedingly long procedure, with such elimination of the rest break substantially decreasing the amount of time during which a patient must remain anesthetized.

It will also be understood that modifications may be made to the surgeon's perch 10 of the present invention without departing from the teachings herein. Accordingly the scope of the invention is only to be limited as necessitated by the accompanying claims.

I claim:

1. A surgeon's perch comprising a base which is a planar member having a front end, a rear end and two opposite side edges, a perch member engaged to a pair of mirror image support bars, one support bar being mounted along each side edge of the base and extending upwardly therefrom, said perch member being elevated above said base, said support bars each having a front edge and a rear edge and a first upper plurality of slots extending downwardly thereinto from the front edge thereof and having a second lower plurality of slots extending upwardly thereinto from the rear edge thereof, and an elevated foot rest including a two ended rod having a depending leg of predetermined length at each end thereof also engaged to said base and positioned between said base and said perch member.

2. The perch of claim 1 wherein said base is made of a firm and trimmable material.

3. The perch of claim 1 wherein said support bars are angled slightly rearwardly upwardly relative to said base.

4. The perch of claim 1 wherein said rod is engaged to and between a predefined one of said second lower slots in each support bar.

5. The perch of claim 1 wherein said perch member has a surface, the surface being configured to be frictional and nonskid.

6. The perch of claim 1 wherein said perch member is horizontally engageable to and between said support bars in one of a plurality of predefined positions.

7. The perch of claim 6 wherein said foot rest is horizontally engageable to and between said support bars in one of a plurality of predefined positions.

8. The perch of claim 1 wherein said perch member has two ends and each end has a pin extending therefrom which is engageable within a preselected first upper slot of each support bar.

9. The perch of claim 8 wherein each pin of said perch member terminates in a hand grip.

10. The perch of claim 1 wherein said legs are co-planar.

11. The perch of claim 10 wherein each leg has a depending end and each depending end is encased within a non-skid material, each leg extending rearwardly downwardly of said rod when said foot rest is engaged to said support bars.

12. The perch of claim 1 wherein each support bar includes a rearwardly upwardly angulated lower end.

13. The perch of claim 12 wherein the lower end of said support bar incorporates a perpendicular flange which rests along said base.

14. A surgeon's perch upon which a surgeon can support his torso in a non-standing position, the perch comprising:

a base, said base having a forward end which is trimmable to align with a base of an operating room table, the base further having a rear end and two side edges;

a pair of mirror image support bars, one support bar being engaged to and along each side edge of the base and extending upwardly therefrom, each support bar having an upper end and a lower base engaging end, and each further having a forward end edge and a rear end edge, each support bar further having a first vertical plurality of slots along the upper end, each slot beginning at the forward end edge and extending rearwardly downwardly into the support bar and each support bar having a second vertical plurality of slots along the lower end, each slot beginning at the rear end edge and extending upwardly and forwardly into the support bar;

a two ended perch member, the perch member being engageable with and between a selected pair of slots in the support bars; and a stabilizing foot rest having two ends which are engageable within and between a pair of selected second slots in the lower end of the support bars, each end of said foot rest further including a leg portion which extends perpendicularly therefrom and terminates in a depending end, the leg portions being co-planar and parallel and of a predefined length such that the depending ends of the legs each contact a supporting surface for the perch regardless of which pair of slots is selected, the legs acting as forwardly bracing structures for the support rods.

* * * * *